US010550459B2

(12) United States Patent
Larnicol et al.

(10) Patent No.: US 10,550,459 B2
(45) Date of Patent: Feb. 4, 2020

(54) DEVICE FOR HYDRODYNAMIC STABILIZATION OF A CONTINUOUSLY TRAVELLING METAL STRIP

(71) Applicant: Centre de Recherches Metallurgiques ASBL-Centrum voor Research in de Metallurgie vzw, Brussels (BE)

(72) Inventors: Maïwenn Larnicol, Saint-Marc (BE); Yves Hardy, Ougree (BE); Olivier Bregand, Sprimont (BE); Pascal Gerkens, Baelen (BE)

(73) Assignee: CENTRE DE RECHERCHES METALLURGIQUES ASBL-CENTRUM VOOR RESEARCH IN DE METALLURGIE VZW, Brussels (BE)

( * ) Notice: Subject to any disclaimer, the term of this patent is extended or adjusted under 35 U.S.C. 154(b) by 0 days.

(21) Appl. No.: 16/072,927

(22) PCT Filed: Jan. 10, 2017

(86) PCT No.: PCT/EP2017/050379
§ 371 (c)(1),
(2) Date: Jul. 26, 2018

(87) PCT Pub. No.: WO2017/129391
PCT Pub. Date: Aug. 3, 2017

(65) Prior Publication Data

US 2019/0032188 A1 Jan. 31, 2019

(30) Foreign Application Priority Data

Jan. 29, 2016 (BE) ..... 2016/5073

(51) Int. Cl.
*C23C 2/22* (2006.01)
*C23C 2/20* (2006.01)
(Continued)

(52) U.S. Cl.
CPC ..... *C23C 2/22* (2013.01); *B05C 1/06* (2013.01); *C23C 2/003* (2013.01); *C23C 2/06* (2013.01);
(Continued)

(58) Field of Classification Search
CPC .... B05C 3/00; B05C 3/02; B05C 3/12; B05C 3/125; B05C 11/06; B05C 11/04;
(Continued)

(56) References Cited

U.S. PATENT DOCUMENTS 2,093,857 A * 9/1937 Williamson ..... C23C 2/06 118/125
2,398,034 A * 4/1946 Oganowski ..... C23C 2/00 118/124
(Continued)

FOREIGN PATENT DOCUMENTS

EP 1586672 A1 10/2005
JP S 55100971 A 8/1980
(Continued)

*Primary Examiner* — Karl Kurple
(74) *Attorney, Agent, or Firm* — Leydig, Voit & Mayer, Ltd.

(57) ABSTRACT

A facility for dip-coating a metal strip in continuous motion includes: a liquid coating metal bath from which the strip exits in a vertical strand; a bottom roller, a decambering roller, and, optionally, a stabilizing roller, all immersed in the liquid-metal bath; drying blades at an exit of the bath, for injecting compressed gas in order to remove excess coating that has not yet solidified so as to create a drying wave having a downward return stream of liquid metal; and a dissipating hydrodynamic-stabilization device placed between the drying blades and a last immersed roller, the dissipating hydrodynamic-stabilization device including a plurality of hydrodynamic pads for applying a load to at least one side of the metal strip and mounted so as to pivot around
(Continued)

hinges so as to self-align the pads, the plurality of hydrodynamic pads extending transversely across a width of the strip.

14 Claims, 4 Drawing Sheets

(51) Int. Cl.

| | |
|---|---|
| ***C23C 2/00*** | (2006.01) |
| ***B05C 11/04*** | (2006.01) |
| ***B05C 1/06*** | (2006.01) |
| ***C23C 2/06*** | (2006.01) |
| ***C23C 2/40*** | (2006.01) |

(52) U.S. Cl.
CPC ..... *C23C 2/20* (2013.01); *C23C 2/40* (2013.01); *B05C 11/04* (2013.01)

(58) Field of Classification Search
CPC .... C23C 2/04; C23C 2/06; C23C 2/08; C23C 2/10; C23C 2/36; C23C 2/38; C23C 2/385; C23C 2/20; C23C 2/22
See application file for complete search history.

(56) References Cited

U.S. PATENT DOCUMENTS 2,413,216 A * 12/1946 Cone ..... C23C 2/22 118/109
2,435,766 A * 2/1948 Baley ..... C23C 2/22 118/109
2,817,312 A * 12/1957 Westby ..... C23C 2/12 118/122
2,914,419 A * 11/1959 Oganowski ..... C23C 2/00 118/206
3,681,118 A * 8/1972 Iwasaki et al. ..... C23C 2/20 427/349
3,930,464 A * 1/1976 Wallsten ..... C21D 9/5732 427/355
4,407,221 A * 10/1983 Peel ..... C23C 2/22 118/109
4,476,805 A * 10/1984 Higuchi ..... B05C 9/02 118/410
4,664,953 A * 5/1987 Copas ..... C21D 9/5732 427/355
5,965,210 A * 10/1999 Tada ..... C23C 2/24 427/434.7
2005/0247262 A1 11/2005 Yoshikawa et al.
2010/0032081 A1* 2/2010 Green ..... B29C 47/0014 156/219
2014/0041582 A1* 2/2014 Van Rijswijk ..... C23C 2/003 118/620
2014/0193586 A1* 7/2014 Poloni ..... C23C 2/06 427/432
2014/0211361 A1* 7/2014 Kurisu ..... C23C 2/24 361/157
2015/0167138 A1* 6/2015 Schaffrath ..... C23C 2/003 427/321
2018/0371598 A1* 12/2018 Kim ..... C23C 2/28

FOREIGN PATENT DOCUMENTS

| | | | |
|---|---|---|---|
| JP | S 5684452 | A | 7/1981 |
| JP | S 56153136 | A | 11/1981 |
| JP | H 051362 | A | 1/1993 |
| JP | H 0810847 | A | 1/1996 |
| JP | H 09143652 | A | 6/1997 |
| JP | H 1087755 | A | 4/1998 |
| JP | H 10298728 | A | 11/1998 |
| JP | 2005171336 | A | 6/2005 |
| JP | 2005298908 | A | 10/2005 |
| WO | WO 03054244 | A1 | 7/2003 |

* cited by examiner

DEVICE FOR HYDRODYNAMIC STABILIZATION OF A CONTINUOUSLY TRAVELLING METAL STRIP

CROSS-REFERENCE TO PRIOR APPLICATIONS

This application is a U.S. National Phase application under 35 U.S.C. § 371 of International Application No. PCT/EP2017/050379, filed on Jan. 10, 2017, and claims benefit to Belgian Patent Application No. BE 2016/5073, filed on Jan. 29, 2016. The International Application was published in French on Aug. 3, 2017 as WO 2017/129391 under PCT Article 21(2).

FIELD

The present invention relates to a dissipating hydrodynamic device allowing to stabilize a metal strip in continuous motion passing through wipers at the end of a dip-coating operation.

The invention more particularly relates to the field of hot-dip galvanization of a steel strip in continuous motion. The hydrodynamic stabilization of the strip is achieved upon exit from the liquid-metal bath, in the vicinity of the wiping device.

BACKGROUND

The so-called "dip-coating" technique is known, which method is both simple and effective for depositing a coating on the surface of an object. According to this technique, after any preparation of the surface, the object to be coated is immersed in a bath comprising the product to be deposited on said object. The object is next extracted from the bath with the excess liquid being removed, and the coating is made solid, for example by wiping, solidification, polymerization, etc.

One of the most widespread applications of this technique is the coating of steel parts such as strips or wires using a metal such as zinc that will next be used for protection against corrosion.

After passing in the liquid-metal bath, the coated part undergoes the wiping operation. This operation is one of the most important operations in the dip-coating method, since it allows to control the final thickness of the coating. On the one hand, the wiping must be homogeneous over the entire surface of the product, i.e., the width for a strip and the circumference for a wire, and over the entire length of the product to be coated. At the same time, this operation must strictly limit the deposition to the target value, which is typically expressed either in terms of deposited thickness—typically from 3 to 50 micrometers—, or by weight of the deposited layer per surface unit—typically in grams/square meter.

Currently, wiping is generally achieved using gas blades or jets, linear in the case of strips and circular in the case of wires, released from slits and most often oriented perpendicular to the surface to be treated. The gas blades act as "pneumatic scrapers" and have the advantage of operating without mechanical contact and therefore without any risk of scratching the treated object. Such blades are called "gas wipers" or "gas knives". The compressed gas implemented is either air, or a neutral gas such as nitrogen in the most delicate applications, such as the treatment of steel strips intended for the manufacture of visible parts for motor vehicle bodies.

The final thickness of the coating in particular depends on the speed of motion of the strip, on the distance between the strip and the gas knives, and lastly, on the action exerted by the compressed gas jet on the strip.

Yet, it is known that when the strip passes over the sink roll, it assumes the form of a tile. This plastic deformation must be corrected by means of a second roll, called a decambering roll, which imparts a reverse plastic deformation to the strip. Secondarily, a third roll, called a stabilizing roll, allows to fix the pass line independently of the decambering. However, poor control of the nesting of the rolls causes residual deformation and therefore deteriorated flatness.

Other phenomena can also alter the flatness of the strip. This may involve heterogeneous quality of the base steel, deteriorated rolling conditions or heating conditions, non-homogeneous cooling and soaking temperature during the annealing cycle of the strip, before it enters the liquid-metal bath.

Furthermore, some characteristics of the facility, such as the presence of cooling devices before the top roll, the off-centered nature of certain rolls, the wear of the rolls or that of the bearings of the immersed rolls, etc., cause vibrations of the strip passing in the wipers.

Ultimately, these flatness defects and these vibrations cause variations in the thickness of the coating that affect the quality of the product and entail zinc overconsumption in order to guarantee a minimal coating thickness for the client.

Furthermore, for a given coating thickness, it is necessary to increase the gas wiping pressure when the speed of the strip increases. Yet, it is known that the motion of the strip cannot exceed a critical speed, beyond which splashing occurs: droplets are torn from the wiping wave and are projected on the surface of the bath and on the equipment. This results in significant deterioration of the quality of the product as well as considerable increase in the volume of scum at the surface of the bath.

To solve these problems, builders have proposed to use pneumatic or electromagnetic devices for decambering and stabilizing the strip or still other devices allowing to avoid splashing. It has also been proposed to mount immersed rolls on ceramic bearings or roller bearings.

Document JP 56 153136 A proposes to arrange at least one pair of pneumatic stabilizers or dampers in positions such that the vibrating length decreases between the sink roll and the top roll, which are fixed points for the strip.

Document JP 56 084452 A proposes to use a pneumatic stabilizer in which part of the injected fluid flows along the strip in the direction opposite that coming from the wipers.

Document JP 2005298908 A proposes to avoid splashing by combining a pneumatic cushion with a scraper, where the gas mixes with the liquid to pass under the scraper.

The goal being to stabilize the strip in the wipers, it is necessary for this type of stabilizer to be located in their vicinity, which involves blowing a compressed gas over a coating having a definitive thickness, but not yet solidified, which risks affecting the appearance of the final product. Moreover, these devices do not guarantee the flatness of the strip at the wipers.

Still other devices for hydrodynamic stabilization have been proposed, like in document WO 03/054244 A1. However, this method requires injecting liquid metal into a pipe using a pump. Furthermore, the width of the pipe by which the strip is engaged does not necessarily adapt to the format of the strip, to the coating rate or to the motion speed of the strip.

Furthermore, a certain number of methods are also known for controlling or suppressing vibrations affecting a metal strip in continuous motion based on the implementation of electromagnetic means (see e.g. documents JP 10 298728 A, JP 5 001362 A, JP 9 143652 A, JP 10 87755 A, JP 8 010847 A).

The electromagnetic methods are based on the following principle. Conductors in which a high-frequency current flows are installed on both sides of the steel strip. They induce currents in phase opposition in the strip, Foucault currents. The interaction between the inducing currents and the induced Foucault currents generates a magnetic pressure tending to stabilize the steel strip. Another solution consists in using electromagnets. However, methods of this type involve additional control due to the magnetic attraction force, which tends to make the strip unstable. Moreover, it is known that the high-frequency currents implemented cause a temperature increase in the strip, which is contrary to what is intended in this step of the method.

The teaching of these various techniques does not allow to completely eliminate vibrations or lack of flatness of the strip, which, even if lessened, generally remain at the gas knives. It is therefore in this location that action should be taken, without altering the formation of the coating.

SUMMARY

In an embodiment, the present invention provides a facility for dip-coating a metal strip in continuous motion, comprising: a liquid-metal bath from which the metal strip exits in a vertical strand; a bottom roll, a decambering roll, and, optionally, a stabilizing roll, all immersed in the liquid-metal bath; gas knives at an exit of the liquid-metal bath, which gas knives are configured to inject compressed gas in order to remove excess coating that has not yet solidified so as to create a wiping wave having a downward return stream of liquid metal; and a dissipating hydrodynamic-stabilization device placed between the gas knives and a last immersed roll, the dissipating hydrodynamic-stabilization device comprising a plurality of hydrodynamic pads configured to apply a load to at least one side of the metal strip and mounted so as to pivot around hinges so as to self-align and accommodate the pads to a local shape of the metal strip, the plurality of hydrodynamic pads extending transversely across a width of the metal strip, and positioned such that, when in use, the downward return stream of liquid metal of the wiping wave flows at least in part over backs of the pads.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
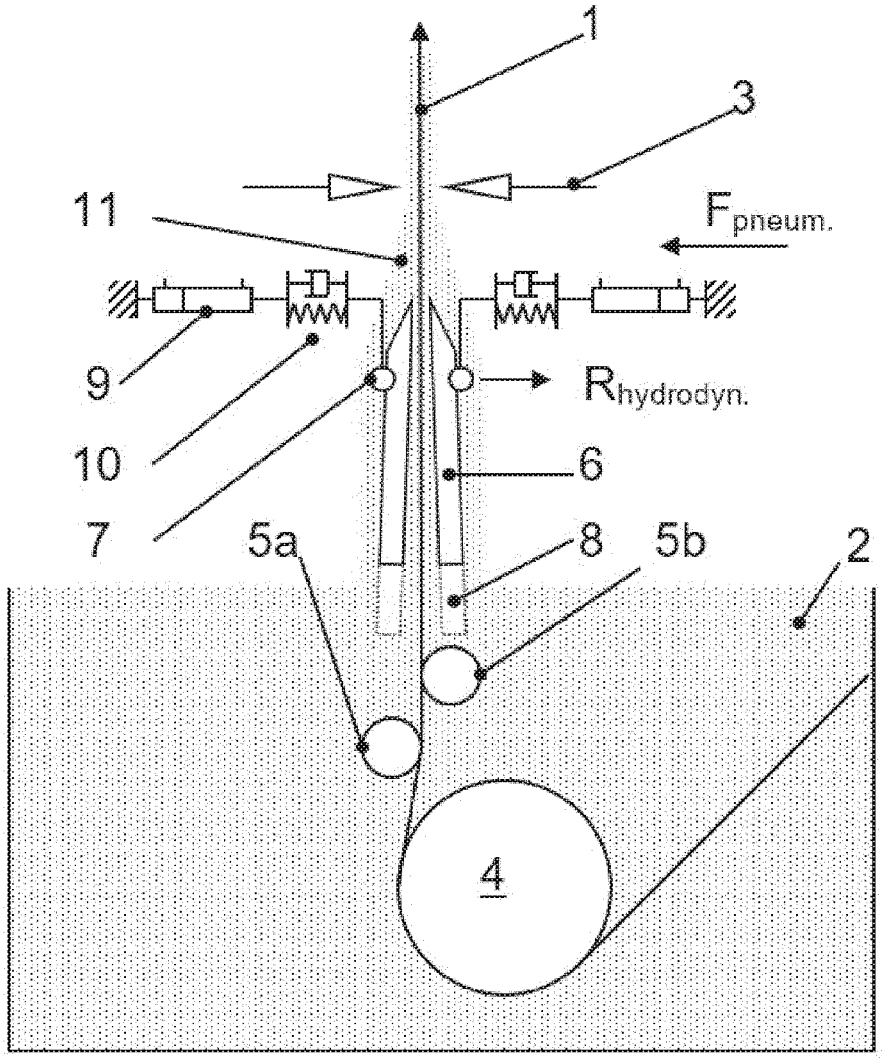
FIG. 1 shows a vertical section view of the hydrodynamic stabilization device of a metal strip according to the present invention.

Embodiments of the present invention provide a solution to the problem of stabilizing a metal strip in continuous motion, that allows to overcome the drawbacks of the state of the art.

Embodiments of the present invention stabilize and/or damp the vibrations of the strip upon leaving a liquid-metal bath owing to hydrodynamic means that allow to dissipate the vibration energy generated in the strip by the facility.

Embodiments of the present invention avoid the implementation, as in the prior art, of additional gas jets in the immediate vicinity of the wipers that could affect the appearance of the final product.

Embodiments of the present invention decamber the strip, and more generally improve the flatness of the strip in the very vicinity of the location where the final thickness of the coating is achieved, i.e. at the wipers, as well as guarantee a uniform coating thickness in the plane of the strip.

Embodiments of the present invention solve the splashing problem encountered at a high motion speed.

The present invention relates to a facility for dip-coating a metal strip in continuous motion, comprising a liquid-metal bath, from which the strip exits in a vertical strand, a sink roll, a decambering roll and, where necessary, a stabilizing roll, all immersed in the liquid-metal bath, gas knives placed at the exit from the bath and injecting compressed gas in order to remove the excess coating that has not yet solidified, creating a wiping wave with a return stream of liquid metal that is oriented downwards, as well as a dissipating hydrodynamic-stabilization device placed between the gas knives and the last immersed roll, comprising a plurality of hydrodynamic pads intended for applying a load to at least one side of the metal strip and mounted so as to pivot around hinges for self-aligning and accommodating said hydrodynamic pads to the local strip shape, also extending transversely across the width of the strip, and positioned such that, when in use, the return stream of liquid metal from the wiping wave flows at least in part over the back of the pads, i.e. over the face thereof that is not facing the metal strip in continuous motion.

According to preferred embodiments of the invention, the facility further comprises at least one of the following features, or even an appropriate combination of several thereof:

- the back of each pad is non-wetting for the liquid metal or is provided with a non-wetting coating;
- at the back of each pad, there is further a channel or grooves channeling the flow of the return stream;

the distal end of the pads relative to the liquid-metal bath is in the wiping zone, is tapered and can provide pre-wiping of the coating by limiting the risk of splashing;

the hinges are arranged such that the tapered distal ends of the pads are quasi-stationary;

the pads are either completely emerged, or are partially or completely immersed in the liquid metal;

the facility comprises an outside heating device for preheating the pads;

the pads located on the same side of the strip are essentially parallel to one another and separated by an interval in the direction that is transverse to the motion of the strip;

the pads located on the same side of the strip are in lateral contact via a ceramic felt placed in this interval;

the pads located on the same side of the strip are in nested lateral contact via a labyrinth joint;

the facility comprises a pneumatic jack for independently loading each pad;

the pneumatic jack is assisted by a spring-dashpot system;

the pads are arranged on each side of the strip while essentially facing one another in pairs;

the pads are arranged on each side of the strip and in staggered rows;

the pads are controlled in groups or individually by a programmable logic control that provides at least a measurement of the camber of the strip, an analysis of the defect and a closed-loop correction of the forces applied on the pads.

The facility of the invention will find a preferred application in the context of an industrial method for the continuous hot-dip coating of a metal strip having a motion speed preferably comprised between 0.5 and >3 meters/second (30 and >180 meters/minute), more preferably up to 10 meters/second (600 meters/minute). In the context of this method, the metal strip will preferably be made from steel, aluminum, zinc, copper, or one of their alloys. The thickness of the metal strip will preferably be comprised between 0.15 and 5 millimeters. The molten coating metal will preferably comprise zinc, aluminum, tin, magnesium, silicon or an alloy of at least two of these elements. The thickness of the metal coating layer obtained after wiping will preferably be comprised between 3 and 50 micrometers. The pressurized gas injected by the gas wipers will preferably be air, nitrogen or carbon dioxide.

To make things clear, FIG. 1 schematically shows one preferred embodiment of the hydrodynamic stabilization device of the invention arranged across from the steel strip 1 driven in a continuous upward movement (i.e., in a vertical strand) after passing by the sink roll 4, the decambering roll 5*a* and optionally by the stabilizing roll 5*b* of the liquid-metal bath 2 and before it passes at the gas knives 3.

The device according to the invention essentially assumes the form of at least one, but generally several, self-aligned (or self-aligning) hydrodynamic pads 6, pivotingly mounted around a hinge 7. Pads refer to rigid planar devices such as plates. They may either be arranged outside the bath 2, or have a partially immersed part 8, or even be completely immersed. The loading of the pads 6 aims to balance the hydrodynamic lift generated within the film of liquid metal at the strip-pad interface, and also to flatten the strip 1 upon its exit from the bath 2.

More specifically, completely emerged or completely immersed pads 6 advantageously allow to avoid trapping scum located at the surface of the bath primarily upon starting up the line, while completely emerged pads favor stabilization as close as possible to the wipers. In addition, partially or completely immersed pads 6 allow to favor preheating and temperature maintenance of the pad by heat conduction via direct contact with the bath. This also allows to take advantage of the speed profile in the vicinity of the strip, just before it leaves the bath, and thus to significantly improve the hydrodynamic lift ($R_{hydrodyn.}$), the thicknesses at the interface, and therefore the operating safety with respect to a risk of contact between the pads and the strip.

Figure 2:
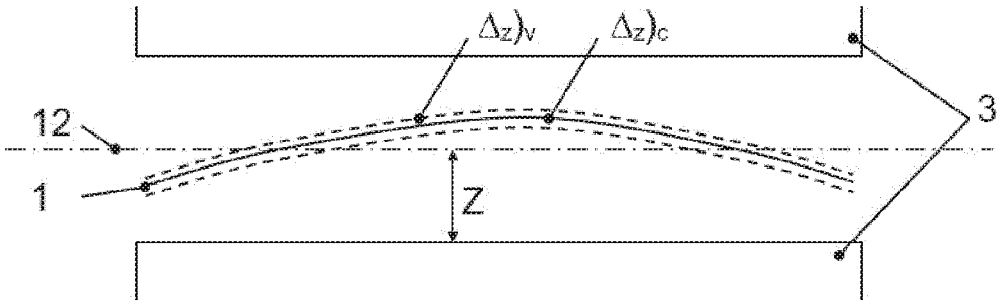
FIG. 2 shows a top view of the strip between the gas knives, schematically showing the distance Z between the knives and the ideal reference plane of the strip, the camber defect Δz)c and the movement Δz)v corresponding to the vibrations.

It can be seen from FIG. 2 that variations in coating thickness will correspond to the camber defects Δz)c and to the movements Δz)v due to the vibrations. Where the strip is closer to a gas knife than the reference plane 12, which is by definition at an equal distance Z from the gas knives, the final coating thickness will be lower, and inversely. More particularly, the camber leads to a continuous variation in thickness over the width of the strip. The vibrations in rigid or "string" mode lead to alternating thickness variations in the motion direction, while higher-order vibrations ("twisting" or "flapping") lead to variations affecting both the longitudinal direction and the transverse direction. The device presented here therefore aims to eliminate these different variations in order to obtain a flat and stable strip at the gas knives and consequently to guarantee uniform coating thickness in both directions of the plane of the strip.

Figure 3:
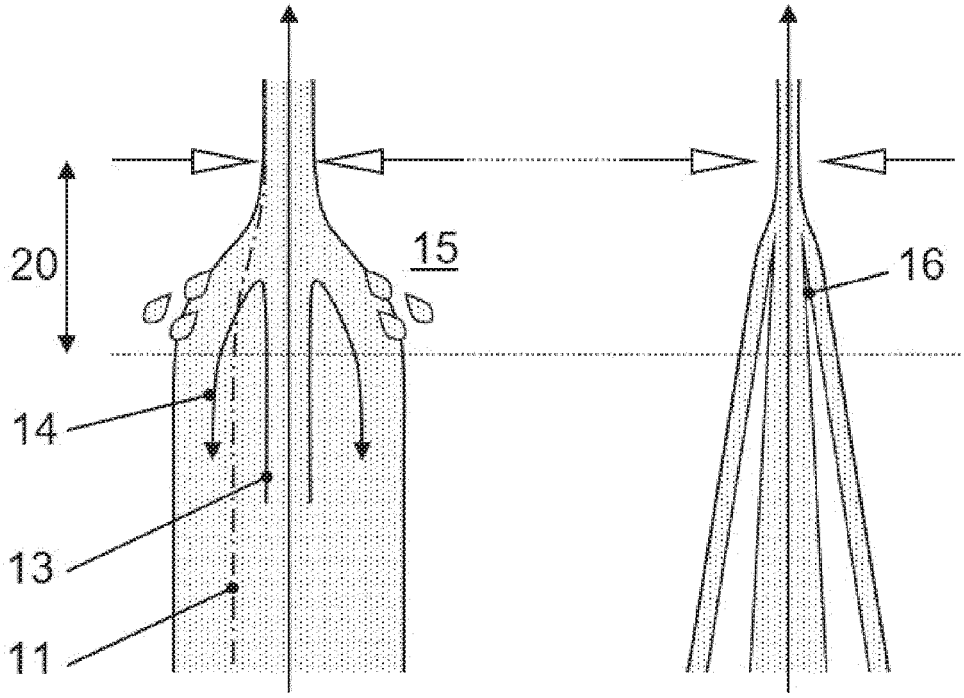
FIG. 3 respectively shows a section view of the wiping wave schematically showing the splashing phenomenon, on the one hand, and the wiping wave in the presence of the end of the hydrodynamic pad, on the other hand.

The splashing phenomenon which occurs beyond a critical motion speed of the strip can be schematically seen from FIG. 3: for a given final thickness, when the speed of the strip increases, the upward stream 13 and the return stream 14 will inflate the thickness of the wiping wave 11. To retain constant final thickness of coating, it is necessary to increase the wiping pressure and therefore the pressure gradient and the shearing of the surface of the fluid film in the wiping zone 20. Past a critical value of the speed-thickness pair, the shearing rate leads to the projection of liquid-metal droplets 15 (splashing). The present invention therefore proposes to limit the thickness of the wiping wave 11 by placing the end of the pad 6, which will preferably be tapered, within the wiping zone 20. The effectiveness will be even better when the back of the pad 6, i.e., its face opposite the strip, is made non-wetting, by nature or by depositing an appropriate coating. In fact, part of the return stream will flow in the back of the pads 6, and it should be avoided that the liquid metal ends up solidifying in this location.

Figure 4:
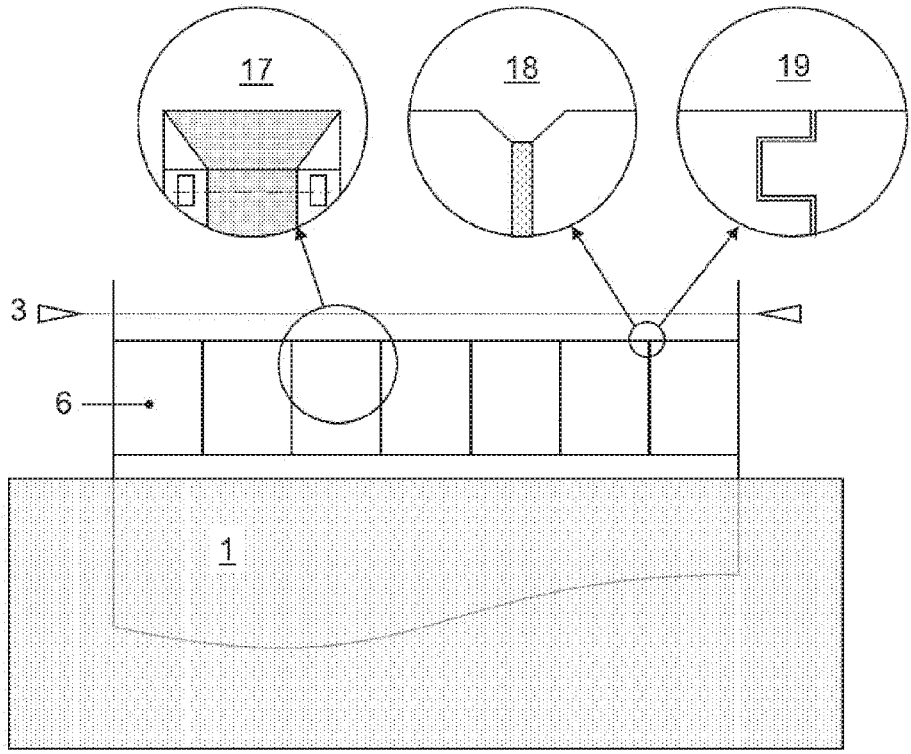
FIG. 4 shows an elevation view of three preferred embodiments of the present invention, relative to the channels present on the back of each pad, on the one hand, and relative to the interface between adjacent pads, on the other hand.

For strips to be coated generally reaching up to 2 meters wide, it is necessary to arrange several pads side by side if the entire width of the strip should be covered. In FIG. 4, the pads 6 are placed on at least one side of the strip 1, and extend transversely essentially over the entire width of the strip 1. For the same reason explained above, the back of each pad 6 advantageously has at least one channel or grooves 17 allowing the return stream to be channeled outside the supports of the hinges. The pads 6 are optionally separated by some distance in the transverse direction and are essentially parallel to one another. Otherwise, they may optionally be in contact via a ceramic felt 18 or be interleaved owing to an assembled labyrinth joint 19 at the level of their adjacent sides opposing the upward stream, which limits the risk of having an overthickness of coating in this location, after wiping.

Figure 5:
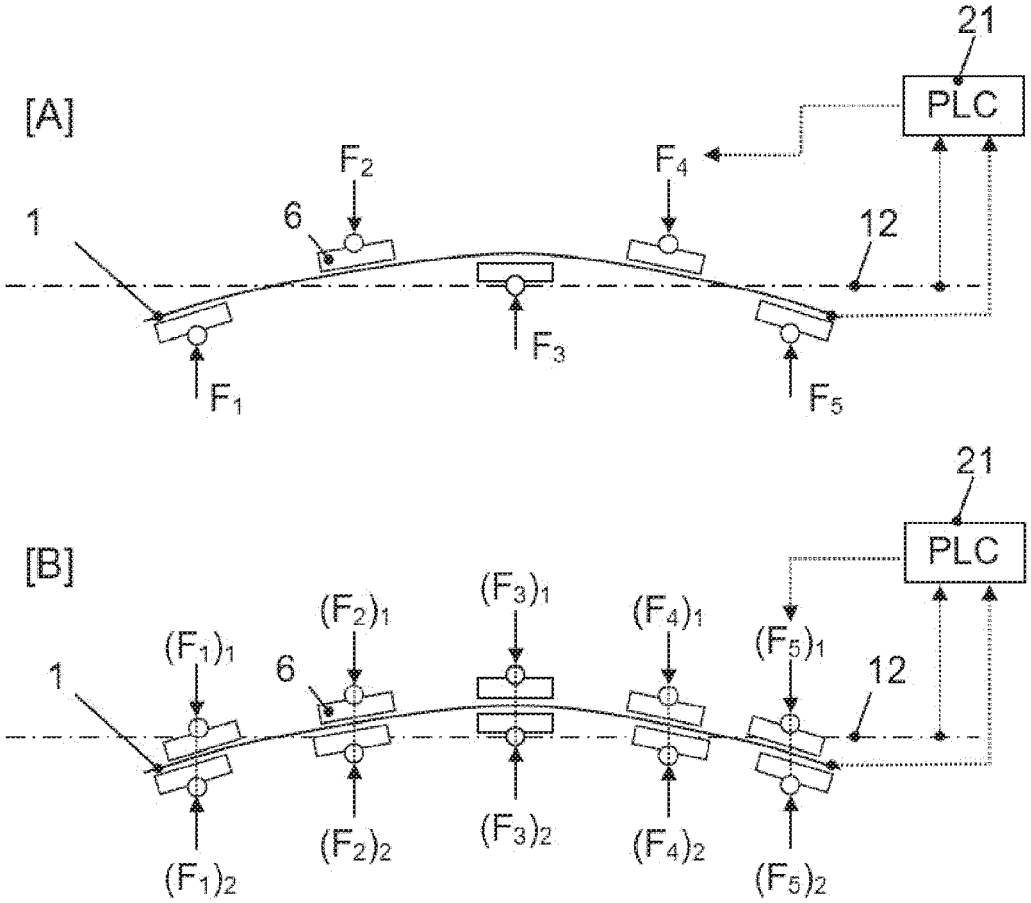
FIG. 5 shows a planar view of two preferred embodiments of the present invention, showing the relative arrangement of the pads on either sides of the strip, according to its camber defect relative to a reference plane.

In a first embodiment shown in FIG. 5 (A), the pads 6 are placed in staggered rows on either sides of the strip 1 shown with its camber defect relative to the reference plane 12. Each pad 6 can be subjected to a same force via its bearing jack or to a particular force (Fi) (i=1, 2, 3, . . . , N). Still according to the invention, a programmable logic control (PLC) can be added to the device for better control of the result while advantageously allowing a measurement of the camber, an analysis of the defect and a closed-loop correction of the forces (Fi).

In the second embodiment shown in FIG. 5 (B), the pads 6 face one another on either sides of the strip 1. Each pair of pads can be subjected to a same force via its bearing jack or to a force differential (Fi)1, (Fi)2 (i=1, 2, . . . , N). Here also, the use of a measurement, analysis and closed-loop correction PLC system can advantageously be considered.

Figure 6:
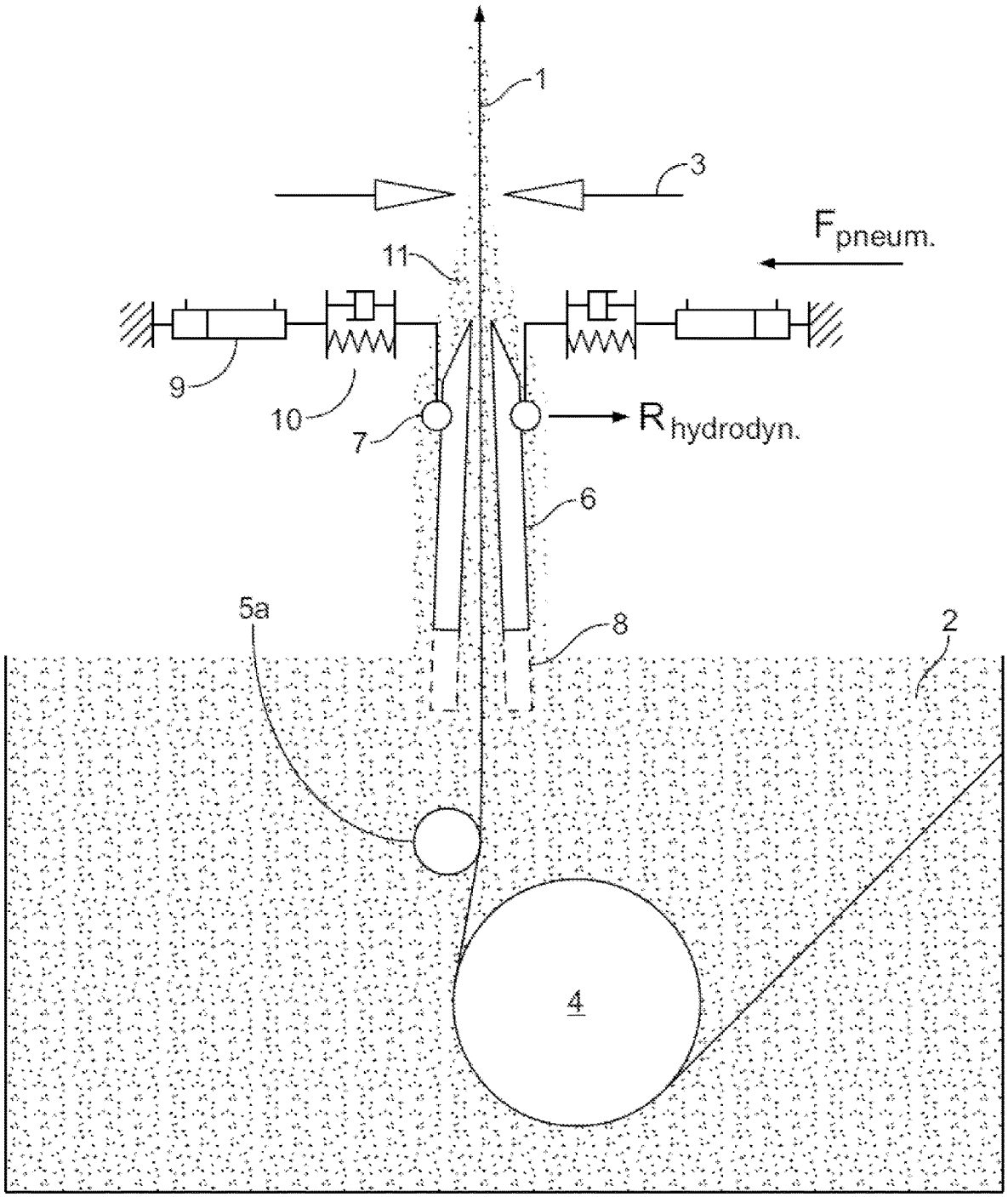
FIG. 6 shows a vertical section view of the hydrodynamic stabilization device of a metal strip according to the present invention, but without the stabilizing roll.

The invention allows, at least under certain operating conditions, to do without the decambering roll 5*a* and stabilizing roll 5*b*, which is even more advantageous given that both generate additional vibrations given the wear of their immersed bearings, that they also generate dross and that their upkeep and replacement require line shutdowns affecting the plant's productivity. An embodiment of the invention without the stabilizing roll 5*b* is shown in FIG. 6.

Other preferred embodiments of the invention may also be considered, differing here by the nature of the dissipation of vibrations achieved. For example, the spring-dashpot system 10 could simply be replaced by the "compressed air-internal friction" assembly of the jack.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of"or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SYMBOLS

1 Steel strip
2 Liquid-metal bath
3 Gas knives
4 Sink roll
5*a* Decambering roll
5*b* Stabilizing roll
6 Hydrodynamic pads
7 Pad hinge
8 Part of immersed pad
9 Pneumatic jack
10 Spring/damper
11 Wiping wave
12 Reference plane
13 Upward stream
14 Return stream
15 Droplets (splashing)
16 Tapered end of pad
17 Channel (groove)
18 Ceramic felt
19 Interleaved pads (baffle)
20 Wiping zone
21 Programmable logic component (PLC)

The invention claimed is:

1. A facility for dip-coating a metal strip with a coating of a liquid-metal in a continuous motion, comprising:

a liquid-metal bath from which the metal strip exits as a vertical strand;

a bottom roll and a decambering roll all immersed in the liquid-metal bath;

gas knives at an exit of the liquid-metal bath, the gas knives being configured to inject a compressed gas in order to remove an excess coating of the liquid-metal that has not yet solidified so as to create a downward return stream of the liquid-metal; and a dissipating hydrodynamic-stabilization device placed between the gas knives and a last immersed roll from a top of the liquid-metal bath, the dissipating hydrodynamic-stabilization device comprising a plurality of pads, the plurality of pads comprising hydrodynamic pads configured to apply a load to at least one side of the metal strip and mounted so as to pivot around hinges so as to self-align and accommodate the plurality of pads to a local shape of the metal strip as the metal strip exits the liquid-metal bath, the plurality of pads extending transversely across a width of the metal strip, each of the plurality of pads having a front which faces the metal strip exiting the liquid-metal bath and a back opposite the front, the back facing away from the metal strip exiting the liquid-metal bath, and positioned such that, when in use, the downward return stream of the liquid-metal flows at least in part over backs of the pads, wherein distal ends of the plurality of pads relative to the liquid-metal bath are in a wiping zone, are tapered, and are configured to provide pre-wiping of the excess coating, and wherein the hinges are arranged such that the distal ends of the plurality of pads are stationary.

2. The facility according to claim 1, wherein the back of each of the plurality of pads is non-wetting for the liquid metal or is provided with a non-wetting coating.

3. The facility according to claim 1, further comprising a channel or grooves configured to channel the flow of the downward return stream of the liquid-metal on the back of each of the plurality of pads.

4. The facility according to claim 1, wherein each of the plurality of pads has a part that is partially immersed in the liquid-metal bath.

5. The facility according to claim 1, where at least a portion of the plurality of pads are located on a same side of the metal strip and are parallel to one another and separated by an interval in a direction transverse to the motion of the metal strip.

6. The facility according to claim 5, wherein the portion of the plurality of pads located on the same side of the metal strip are in lateral contact via a ceramic felt placed in the interval.

7. The facility according to claim 5, wherein the portion of the plurality of pads located on the same side of the metal strip are in interleaved lateral contact.

8. The facility according to claim 1, further comprising a pneumatic jack configured to independently load each of the plurality of pads.

9. The facility according to claim 8, wherein the pneumatic jack is assisted by a spring-dashpot system.

10. The facility according to claim 1, wherein the plurality of pads are arranged on each side of the metal strip while facing one another in pairs.

11. The facility according to claim 1, wherein the plurality of pads are arranged on each side of the metal strip and in staggered rows.

12. The facility according to claim 10, wherein the plurality of pads are configured to be controlled in groups or individually by a programmable logic control that provides at least one measurement of a camber of the metal strip, an analysis of a defect, and a closed-loop correction of forces applied on the pads.

13. The facility according to claim 1, further comprising a stabilizing roll immersed in the liquid-metal bath.

14. A facility for dip-coating a metal strip with a coating of a liquid-metal in a continuous motion, comprising:

a liquid-metal bath from which the metal strip exits with an upward movement;

a bottom roll and a decambering roll all immersed in the liquid-metal bath;

gas knives at an exit of the liquid-metal bath, the gas knives being configured to inject a compressed gas in order to remove an excess coating of the liquid-metal that has not yet solidified so as to create a downward return stream of the liquid-metal; and a dissipating hydrodynamic-stabilization device placed between the gas knives and a last immersed roll from a top of the liquid-metal bath, the dissipating hydrodynamic-stabilization device comprising a plurality of pads, the plurality of pads comprising hydrodynamic pads configured to apply a load to at least one side of the metal strip and mounted so as to pivot around hinges so as to self-align and accommodate the plurality of pads to a local shape of the metal strip as the metal strip exits the liquid-metal bath, the plurality of pads extending transversely across a width of the metal strip, each of the plurality of pads having a front which faces the metal strip exiting the liquid-metal bath and a back opposite the front, the back facing away from the metal strip exiting the liquid-metal bath, and positioned such that, when in use, the downward return stream of the liquid-metal flows at least in part over backs of the pads, where at least a portion of the plurality of pads are located on a same side of the metal strip and are parallel to one another and separated by an interval in a direction transverse to the upward movement of the metal strip, and wherein the portion of the plurality of pads located on the same side of the metal strip are in interleaved lateral contact.

* * * * *